United States Patent [19]

Vroomen

[11] Patent Number: 4,563,798

[45] Date of Patent: Jan. 14, 1986

[54] CORDUROY CUTTING MACHINE

[75] Inventor: Albert Vroomen, Monchen-Gladbach, Fed. Rep. of Germany

[73] Assignee: Franz Müller GmbH & Co., Monchen-Gladbach, Fed. Rep. of Germany

[21] Appl. No.: 702,812

[22] Filed: Feb. 19, 1985

Related U.S. Application Data

[63] Continuation-in-part of Ser. No. 451,890, Dec. 21, 1982, abandoned.

[30] Foreign Application Priority Data

Dec. 22, 1981 [DE] Fed. Rep. of Germany ..... 3150734

[51] Int. Cl.[4] ..... D06C 13/08

[52] U.S. Cl. ..... 26/10 C

[58] Field of Search ..... 26/8 R, 8 C, 9, 10 R, 26/10 C

[56] References Cited

U.S. PATENT DOCUMENTS 2,895,209 7/1959 Sanders ..... 26/10 C 3,044,141 7/1962 Gaskins ..... 26/10 C

*Primary Examiner*—Robert R. Mackey

*Attorney, Agent, or Firm*—Herbert L. Lerner; Laurence A. Greenberg

[57] ABSTRACT

Corduroy cutting machine, including a shaft, a plurality of circular knives disposed adjacent each other on the shaft for cutting open floating wefts of a fabric web being movable along a given travel direction, a plurality of needles being normally movable in a given working area, the needles having points and having longitudinal slots formed therein for receiving portions of the knives at a cutting edge, the needles being insertable into the floating wefts to be cut open in a direction opposite the given travel direction, upper and lower contact strips being respectively disposed above and below the needle points, at least one of the contact strips being actuatable for stopping the cutting machine upon contact by one of the needles, the needles and the lower contact strip defining a working plane onto which the fabric is guidable from below over the lower contact strip to the cutting edge, the lower contact strip being lowerable from the working plane, and a collecting rail being associated with the upper contact strip for prohibiting an advance of the needles from the cut fabric web substantially beyond the given working area of the needle movement.

2 Claims, 4 Drawing Figures

CORDUROY CUTTING MACHINE

CROSS REFERENCE TO RELATED APPLICATION

This is a Continuation in Part of Application Ser. No. 451,890, filed Dec. 21, 1982, now abandoned.

BRIEF DESCRIPTION OF THE INVENTION

1. Field of the Invention

The invention relates to a corduroy cutting machine having a shaft on which a plurality of circular knives are mounted adjacent one another, the knives dip into longitudinal slots formed in needles which are pushed into floating wefts to be cut open in the direction opposite that of the fabric web, and lower and upper contact strips which are respectively disposed below and above the points of the needles. By touching the strips through a needle, the strips operate a switch for stopping the machine, whereby the lower contact strip is lowered from the working plane, which extends through the contact strip and the needles, and the fabric web is drawn from below into the working plane and over the lower contact strip to the cutting edge, which is associated with the shaft.

2. Description of the Prior Art

An apparatus of this type is described in German Published, Non-Prosecuted Application DE-OS 30 33 792, corresponding to U.S. Application Ser. No. 600,604. In such a device, the fabric web, which is first drawn under tension over the contact table to the cutting edge, is then lowered arbitrarily so that all of the needles exit upward and thereby the needles are all cut free together with the speed of the fabric web. Through this simultaneous cutting free of the needles, the total time required for the needle transmission at a seam passage, which otherwise was required for withdrawing the needles from the uncut fabric web segment, is shortened.

When the needles are cut free, they are no longer held through the fabric web or the weft tubes, respectively. Then, a certain hold still exercises pressure from the upper contact strip. However, the contact strip can be lightly lifted up through single groups of needles.

However, when the needles do not have a single hold at the moment of being finally cut free, the needles can be thrown forward through the friction force between the needle slot and its respective circular knife. This can result in a diaster, since the rear soldered area of the forward thrown needles is cut through, the circular knife is damaged correspondingly, and the loosened needles fly indiscriminately into the machine.

SUMMARY OF THE INVENTION

It is accordingly an object of the invention to provide a corduroy cutting machine, which overcomes the hereinafore-mentioned disadvantages of the heretofore-known devices of this general type, and to create a means for the secure holding of all of the needles from cutting free until the machine stops.

With the forgoing and other objects in view there is provided, in accordance with the invention, a corduroy cutting machine, comprising a shaft, a plurality of circular knives disposed adjacent each other on said shaft for cutting open floating wefts of a fabric web being movable along a given travel direction, a plurality of needles being normally movable in a given working area, the needles having points and having longitudinal slots formed therein for receiving portions of the knives at a cutting edge, the needles being insertable into the floating wefts to be cut open in a direction opposite the given travel direction, upper and lower contact strips being respectively disposed above and below the needle points, at least one of the contact strips including a switch being actuatable for stopping the cutting machine upon contact by one of the needles, the needles and the lower contact strip defining a working plane onto which the fabric is guidable from below over the lower contact strip to the cutting edge, the lower contact strip being lowerable thereby from the working plane, and a collecting rail being associated with the upper contact strip for prohibiting an advance of the needles from the cut-free fabric web substantially beyond said given working area of said needle movement.

Through the use of the collector rail coupled with the upper contact strip, the needles are held independently of their influence on the upper contact strip after cutting free. This is done in any manner, such as mechanically or magnetically, so that the needles are essentially not thrown forward from the area of their normal working movement.

In accordance with a concomitant feature of the invention, the collecting rail is in the form of a lid being swingable about an axis extended parallel to the upper contact strip, the lid having a free end lying with its weight against the fabric web during normal operation of the cutting machine, the free end of the lid having a channel formed therein swinging directly in front of the needle points when the fabric web is lowered. However, at the moment in which the fabric web is arbitrarily lowered, shortly before a seam, the collecting rail according to the invention is also lowered, so that the needles can only be thrown forward into the channel of the collecting rail after they are cut free. Therefore, the distance between the channel and the needle points should be large enough to ensure that the circular knife does not touch the rear tight soldering of the needle, when the needle point touches the channel.

Other features which are considered as characteristic for the invention are set forth in the appended claims.

Although the invention is illustrated and described herein as embodied in corduroy cutting machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
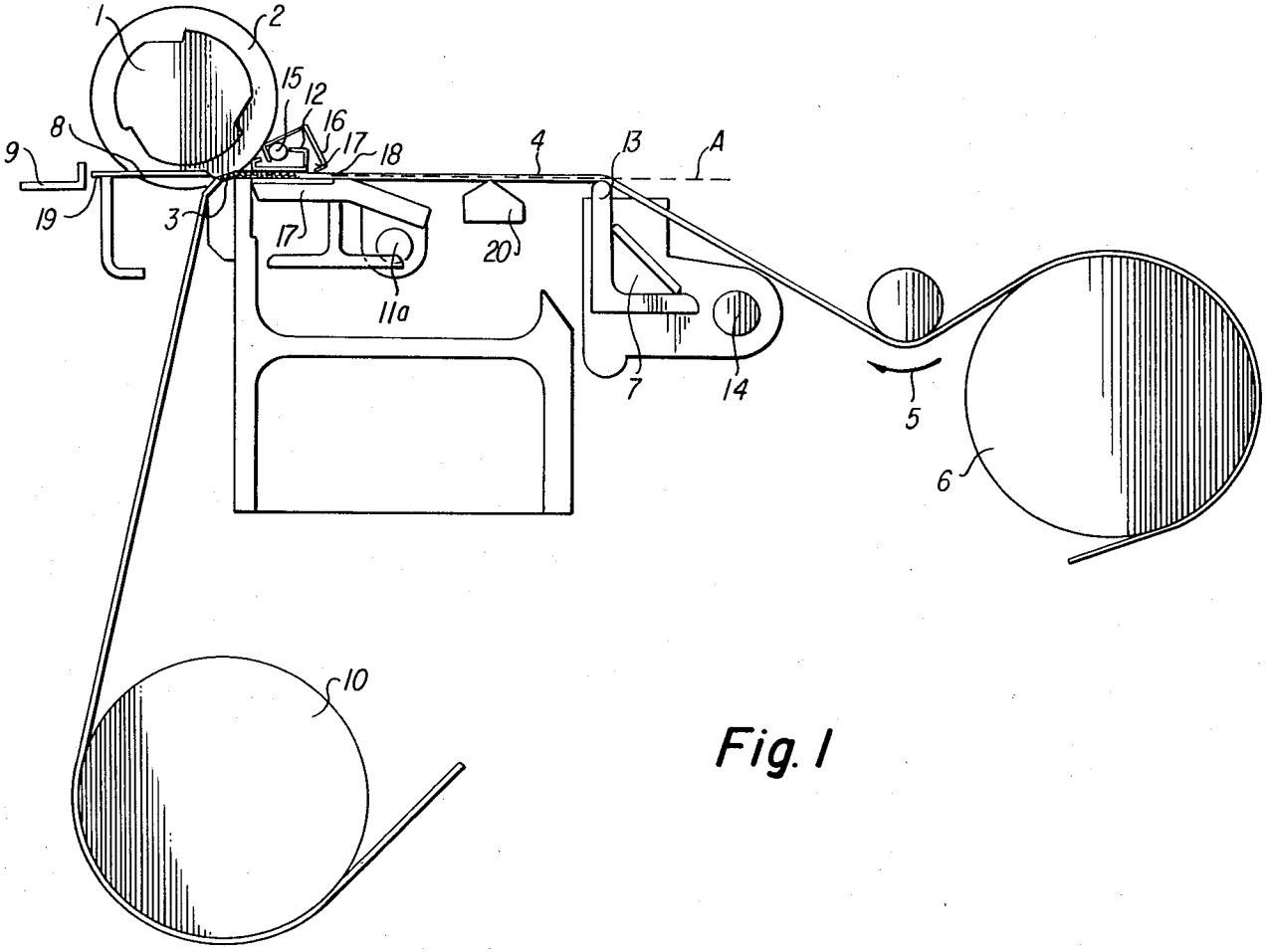
FIG. 1 is a partially cross-sectional view normal to the axis of a cutting knife shaft through a corduroy cutting machine with a fabric web for normal cutting operation.
Figure 2:
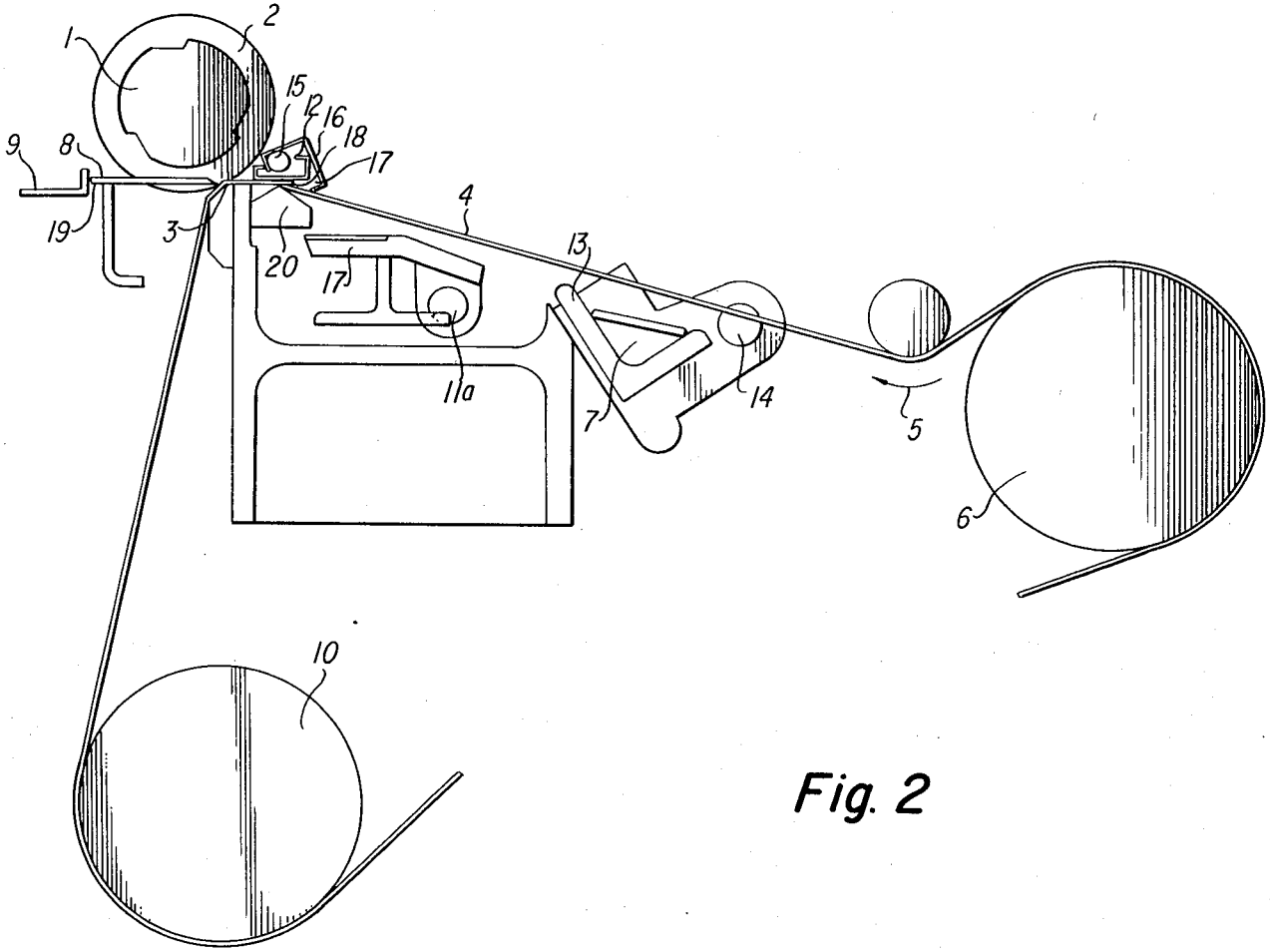
FIG. 2 is a similar view of the machine according to FIG. 1 with the fabric web lowered.

Referring now in detail to FIGS. 1 and 2 of the drawings as a whole, it is seen that the machine has a plurality of circular knives 2 laterally adjacent one another on a knife shaft 1. The circular knives 2 are associated with a cutting edge 3. A fabric web 4 travels in the direction of an arrow 5, over a feed roller 6 and a so-called rear table 7 onto needles 8 which are disposed at the cutting edge 3, so that a needle 8 is led into each of the weft tubes of the fabric web 4, which are to be cut open.

The respective circular knife 2 associated with a needle, projects through a longitudinal slot which is provided in each needle in such a way that the circular knife 2 projects up to a given distance from the cutting edge 3, which is determined especially by the thickness of the ground web or backing of the fabric web 4. The needles have a point at one end and at the opposite end a tightly soldered area 19, which seals the slot on the rear side. As a rule, needles 8 are alternately pushed from behind by rams or pestles 9 so that they are pressed forward in a jerky manner into the respective weft tube of the fabric web 4. The respective longitudinal tension or stretching in the warp direction of the fabric web, which is required for acceptable cutting, is secured through a take-up roller 10 as well as through the feed roller 6.

For the registration of the downward needle withdrawal and for guiding of the fabric web 4 in the area of the needles 8, the corduroy cutting machine has a so-called lower contact strip 11 and an upper contact strip 12, respectively. Through the use of these strips and by using different needle lengths, it is guaranteed that with the downward or upward needle withdrawal, a safe stopping of the machine for a short time takes place, by way of a signal which is passed on from the contact strip 11, 12 to a switch associated therewith, and the withdrawal of the respective needle 8 comes to a stand still before moving on to the cutting edge 3. The term "withdrawal" in this context is understood to mean that the needles penetrate through or emerge from the base or substrate and the pile of the fabric web. Obviously, contact strips 11, 12 must then be disposed at a certain distance from the cutting edge 3 in the fabric web travelling direction 5, which depends on the speed of the machine and the braking capability.

During the normal operation of the machine, according to FIG. 1, the rear table 7 with a specific rear table edge 13, is at the same height as the cutting edge 3 and in a so-called working plane A. At the same time, the contact strips 11, 12 lie so close to the fabric web 4 on both sides, that during the needle withdrawal, all current needle lengths cause an immediate stop of the machine.

Figure 4:
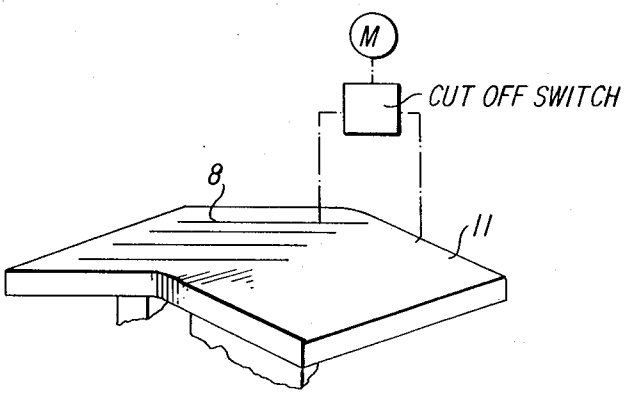
FIG. 4 is an enlarged, fragmentary, perspective view of the contact table and the mechanism for stopping the machine.

As seen in the enlarged view of the contact table in FIG. 4, a cut off switch is connected to the needles, the contact table and a motor driving the machine. When the needles 8 touch the contact table 11, the switch stops the motor.

In the illustrated embodiment, it is assumed that the lower contact strip 11 is in the form of a carrier, which can be lowered. For starting, such as if cutting the needles free before a seam is desired, the rear table 7 according to FIG. 2 swings downward around its pivot axis 14, so that the fabric web 4 is fed from below onto the working plane A, which is outstretched from the needles 8. The entrance point of the fabric web 4 into the working plane A is therefore determined by the position of a needle supporting table 20, which moves at the same time or subsequent to the pivoting movement of the table 7 in the area of the previously lowered, lower contact strip 11 under the needle 8. By displacement of the entrance point of the fabric web 4 in the working plane A under the needles 8, all the needles exit upward from their respective weft tubes, beginning with their points. In this connection, as a rule it is advisable for the contact strips 11 and 12 (together with the lowering of the rear table 7) to be disengaged from their function as a signal transmitter. With the down-swing of the fabric web 4 according to FIG. 2, a lid or trap in the form of a collecting or tucking rail 16 which is coupled with the upper contact strip 12 according to the invention and is swingable around an axis 15 extending parallel to the contact strip, moves from the normal position above the working plane to a position in which a channel 17 provided at the free end thereof is in the area directly in front of the free needle points, which are indicated with reference numberal 18 in FIG. 2. This assures that after the completed free cutting through the circular knives 2, the needles 8 can be thrown forward no further than the channel 17. The clear motion is therefore adjusted in such a way that during the forward movement of the needles 8 in the direction opposite the fabric web movement, the tightly soldered back region 19 of the needles is not touched by the knives 2.

Figure 3:
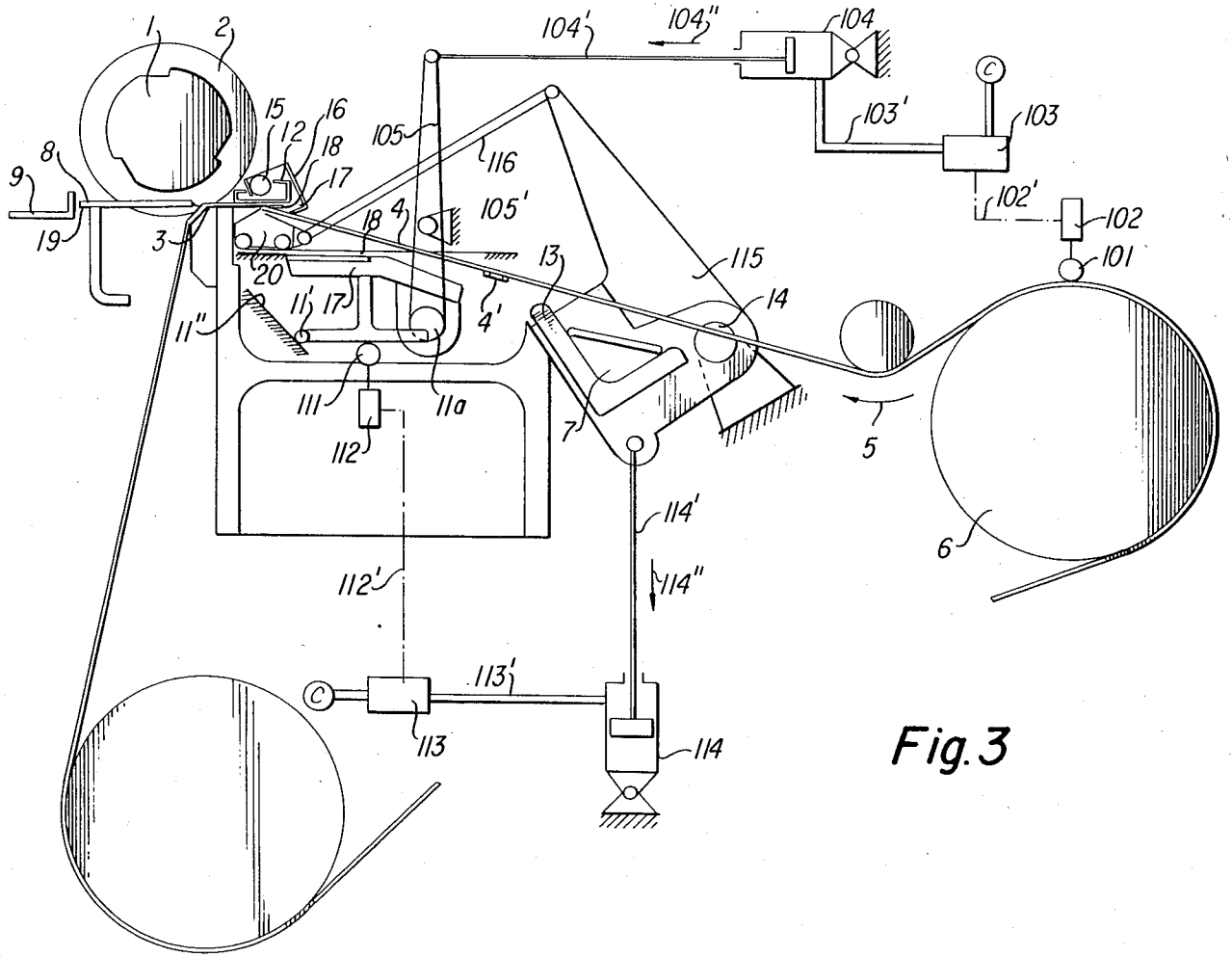
FIG. 3 is a view similar to FIG. 2 including details of the mechanism for operating the tables of the invention.

According to FIG. 3, when a seam 4' passes a seam feeler or electric eye 101, it trips a switch 102 which opens a pneumatic valve 103 over a line 102'. The valve 103 allows the passage of compressed air from a compressed air source C into a tube 103' leading to a pneumatic cylinder 104. The air supply moves a piston to the left in FIG. 3 which moves a piston rod 104' in the direction of the arrow 104''. The piston rod moves a lever 105 through a pivot joint. The lever is pivoted at a bracket 105' and is connected to the contact table 11 at a pivot point 11*a*. The lever 105 therefore moves the contact table 11 from the position shown in FIG. 1 to the lowered position shown in FIGS. 2 and 3. The table 11 has a roller 11' which moves along an inclined surface 11''.

When the contact table 11 is lowered, it contacts a feeler 111 which trips a switch 112. The switch 112 signals a pneumatic valve 113 over a line 112' so that compressed air from a compressed air source C enters a tube 113'. The tube is connected to a pneumatic cylinder 114 having a piston and a piston rod 114'. The compressed air moves the rod 114' in the direction of the arrow 114'' in order to pivot the rear table 7 about the axis 14.

A lever 115 is attached to the rear table 7 and is articulatingly connected through a rod 116 to the supporting table 20. When the rear table 7 is lowered into the position shown in FIGS. 2 and 3, the supporting table 20 is therefore slid to the left along the guideway 18. Naturally, many different mechanisms can be used for coordinating movement of the three tables and FIG. 3 illustrates but one. Furthermore, the device can be operated manually. When an operator sees a seam 4' approaching, he merely lowers the rear table 7 about the axis 14 and pushes the supporting table 20 to the left. The contact table 11 can be constructed as a springy resilient table, as mentioned above, so that the weight of and tension on the web 4, lowers the table 11. Otherwise, the table 11 can also be lowered manually.

I claim:

1. Corduroy cutting machine, comprising means for moving a fabric web in a given travel direction, a shaft, a plurality of circular knives disposed adjacent each other on said shaft for cutting open floating wefts of the fabric web being movable along said given travel direction, a plurality of needles being normally novable in a given working area, said needles having points and having longitudinal slots formed therein for receiving portions of said knives at a cutting edge, means for inserting said needles into the floating wefts to be cut open in a direction opposite said given travel direction, upper and lower contact strips being respectively disposed above and below said needle points, means responsive to contact between at least one of said needles and at least one of said contact strips for stopping the cutting machine, said needles and said lower contact strips defining a working plane onto which the fabric is guidable from below over said lower contact strip to said cutting edge, means for lowering said lower contact strip from said working plane, a rear table supporting the fabric web in said working plan upstream of said contact strips as seen in said given travel direction, means for lowering said rear table with the fabric web from said working plane upon actuation of the stop motion, a needle supporting table being movable along said working plane, a collecting rail being associated with said upper contact strip for prohibiting an advance of said needles from the cut fabric web substantially beyond said given working area of said needle movement and means for moving said needle supporting table below said needles when said rear table is lowered and said collecting rail prohibits the advance of said needles.

2. Corduroy cutting machine according to claim 1, wherein said collecting rail is in the form of a lid being swingable about an axis extended parallel to said upper contact strip, said lid having a free end lying with its weight against the fabric web during normal operation of the cutting machine, said free end of said lid having a channel formed therein swinging directly in front of said needle points when the fabric web is lowered.

* * * * *